US006080289A

United States Patent [19]

Palmatier et al.

[11] Patent Number: 6,080,289

[45] Date of Patent: Jun. 27, 2000

[54] ELECTROPLATING APPARATUS WITH SELF-CLEANING CONTACTS

[75] Inventors: Phillip W. Palmatier, Hopewell Junction; Tracy A. Tong, Pleasant Valley, both of N.Y.

[73] Assignee: International Business Machines Corporation, Armonk, N.Y.

[21] Appl. No.: 09/181,164

[22] Filed: Oct. 28, 1998

[51] Int. Cl.[7] ..... C25B 9/00; C25D 17/04

[52] U.S. Cl. ..... 204/242; 204/275; 204/279; 204/297 R; 204/297 W

[58] Field of Search ..... 204/297 R, 297 W, 204/242, 286, 225, 275, 279

[56] References Cited

U.S. PATENT DOCUMENTS 4,781,813 11/1988 Archer et al. ..... 204/297 W
4,844,779 7/1989 Callahan ..... 204/242 X
5,456,814 10/1995 Metzka ..... 204/297 W
5,904,820 5/1999 Brown et al. ..... 204/279 X

*Primary Examiner*—Donald R. Valentine
*Attorney, Agent, or Firm*—Ratner & Prestia; Ira D. Blecker

[57] ABSTRACT

An electroplating apparatus comprising a plating tank containing electroplating solution, one or more substrates to be electroplated, and an electrical contact mechanism. The electrical contact mechanism comprises a first set of one or more conductive contacts electrically connected to a power supply and a second set of one or more conductive contacts mounted to a substrate carrier. The second set of contacts wipes against the first set of contacts when the carrier is maneuvered into and out of a plating position. At least one of the first and second sets of contacts is spring-biased. The first set of contacts may comprise one or more inverted-L-shaped, pivotable contacts, each mounted within a notch in a contact block.

18 Claims, 3 Drawing Sheets

ELECTROPLATING APPARATUS WITH SELF-CLEANING CONTACTS

TECHNICAL FIELD

The present invention relates generally to electroplating apparatus and, more specifically, to an electrical contact mechanism for an electroplating apparatus used in the manufacture of integrated circuits.

BACKGROUND OF THE INVENTION

Electroplating operations are often used in many industrial applications, such as for plating thin film wiring onto ceramic substrates to manufacture integrated circuits for the semiconductor industry. FIGS. 1 and 2 show a side view and a top view, respectively, illustrating a typical electroplating apparatus 100 used in such manufacture. Plating tank 101 contains an acid bath of electroplating solution that generally comprises metal ions in an acid solution.

Plating tank 101 may be separated into two isolated compartments 12 and 14 by a divider 16. Each compartment 12, 14 is outfitted for an independent electroplating operation. One or more plating fixtures 18, each containing a substrate 19 to be plated, is or are attached to a substrate carrier such as flybar 20. Flybar 20 is moved by a robot (not shown) that grabs flybar 20 at robot interface 22. Flybar 20 is lowered vertically in the direction of arrow "A" into plating tank 101.

When flybar 20 has been fully lowered into a plating position where plating fixtures 18 are submerged inside plating tank 101, fixed contact blocks 24 on opposite ends of flybar 20 become aligned with movable contact mechanisms 26 attached externally to plating tank 101. Fixed contact block 24 and movable contact mechanism 26 adjacent plating tank compartment 12 provide an independent electrical contact mechanism for compartment 12 that is isolated from the equivalent, mirror-image components related to and adjacent compartment 14.

Referring now to FIGS. 3 and 4, there are shown enlarged illustrations of a top and side view, respectively, of movable contact mechanism 26. Movable contact mechanism 26 essentially comprises a frame 30, to which is attached a piston or air plunger 32 that is linked by linkage 33 to movable contact block 34. Rollers 35 may be present if any horizontal motion of flybar 20 is necessary after it comes to rest on frame 30. Fixed contact block 24, as shown in FIGS. 1 and 2, and movable contact block 34 each further comprise a set of fixed contacts 36 and 36' and 37 and 37', respectively. Each contact 36, 36', 37, and 37' may merely comprise the protruding threaded end of a screw 38 threaded through respective contact block 24 or 34.

When contact blocks 24 and 34 are aligned, movable contact mechanism 26 is activated. Piston 32 retracts so that linkage 33 pivots about pin 40, thus moving contact block 34 toward fixed contact block 24 along the direction of arrow "B" to reach the closed position as shown in FIGS. 3 and 4. When the electroplating operation is finished, piston 32 extends so that linkage 33 pivots about pin 40 in opposite direction, thus moving contact block 34 in the direction opposite arrow "B" to an open position (not shown).

In the closed position, contacts 36 and 36' touch contacts 37 and 37' respectively and electrical current flows from independent power supplies (not shown) connected one each to contacts 37 and 37'. The power supply attached to contact 37 is generally at a different potential than the power supply attached to contact 37'.

Thus, a first current having a first potential flows through contact 37 into contact 36 and a second current having a second potential flows through contact 37' into contact 36'. Both currents flow through independent electrical connections (not shown) across flybar 20 to the plating fixtures 18, where one current is attached to the substrate 19 and one is attached to the "thief" 21, shown in FIG. 1. Thus, the cathode potentials of the substrate 19 and thief 21 interact with each other and with an anode (not shown) submerged in the electroplating solution to uniformly attract and adhere metal ions from the solution to the substrate 19. The differing potentials of substrate 19 and thief 21 interact to eliminate the edge effect, excess plating on the edges as compared to the center of the substrate 19, as is well-known in the art.

Because of the acidic, corrosive atmosphere created by the highly acidic electroplating solution, contacts 36, 36' and, in particular, 37, 37' may corrode. The corroded contacts may produce non-conductive corrosion byproducts, over time, that build-up upon the mating surface of contacts 36, 36' and 37, 37'. Thus, after some period of time, the electrical contact provided between contacts 36, 36' and 37, 37' may deteriorate and become intermittent. A poor or intermittent electrical connection may lead to incomplete plating of the conductive metal onto the substrate 19. These incompletely plated substrates may then be classified as unrecoverable scrap.

Therefore, there is a need for electroplating apparatus having electrical contacts that overcome the problems caused by corrosion in the hostile electroplating environment.

SUMMARY OF THE INVENTION

To meet this need, and in view of its purposes, the present invention provides an electroplating apparatus comprising a plating tank containing electroplating solution, one or more substrates to be electroplated, and an electrical contact mechanism. The electrical contact mechanism comprises a first set of one or more conductive contacts electrically connected to a power supply and a second set of one or more conductive contacts mounted to a substrate carrier. The carrier is adapted to maneuver the substrates into and out of a plating position and to carry current to the substrates from the second set of contacts when the carrier is in the plating position. The second set of contacts is positioned to touch the first set of contacts when the carrier is in the plating position and to wipe against the first set of contacts when the carrier is maneuvered into and out of the plating position. At least one of the first and second sets of contacts is spring-biased.

The first set of contacts may be spring-biased and mounted within a contact block having one or more notches. The spring-biased contacts further comprise one or more pivotable contacts, optionally in the shape of an inverted L, each pivotable contact pivotably mounted within one of the contact block notches. Each pivotable contact has a wiping component with an interior side and an exterior side. A spring, mounted in the contact block notch between the contact block and the interior side of the wiping component of the pivotable contact, is positioned to bias the pivotable contact away from the contact block.

It is to be understood that both the foregoing general description and the following detailed description are exemplary, but are not restrictive, of the invention.

BRIEF DESCRIPTION OF DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1:
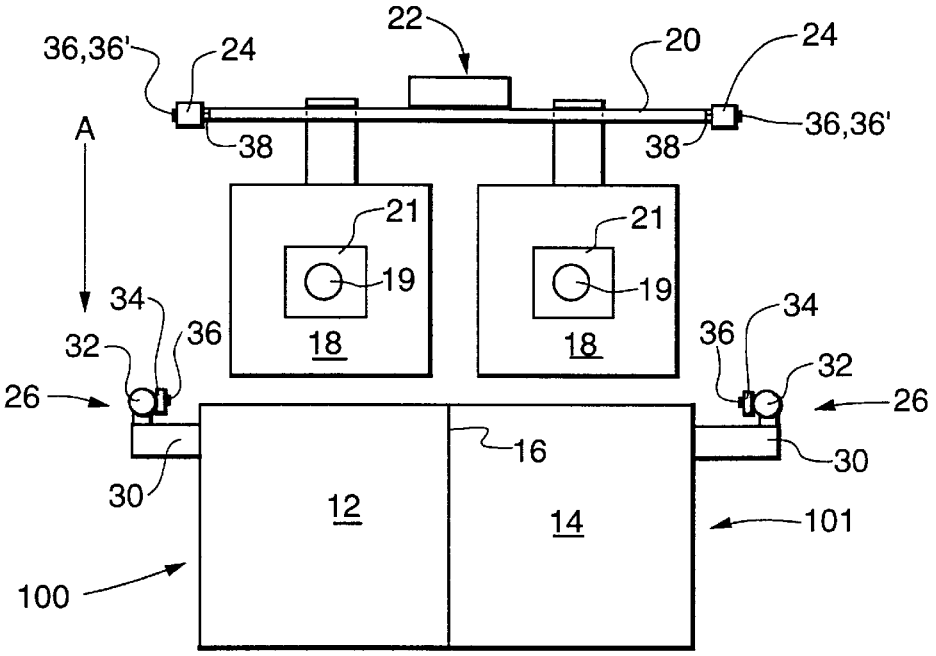
Fig. 1 (PRIOR ART)
FIG. 1 is a side view illustrating a typical plating apparatus having an electrical contact mechanism of the prior art.
Figure 2:
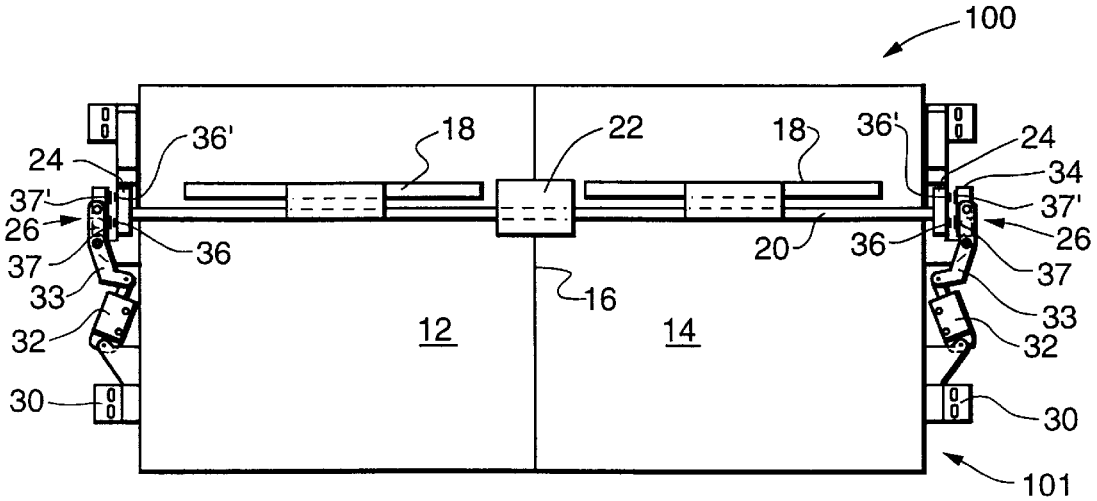
Fig. 2 (PRIOR ART)
FIG. 2 is a top view illustrating the apparatus of FIG. 1.
Figure 3:
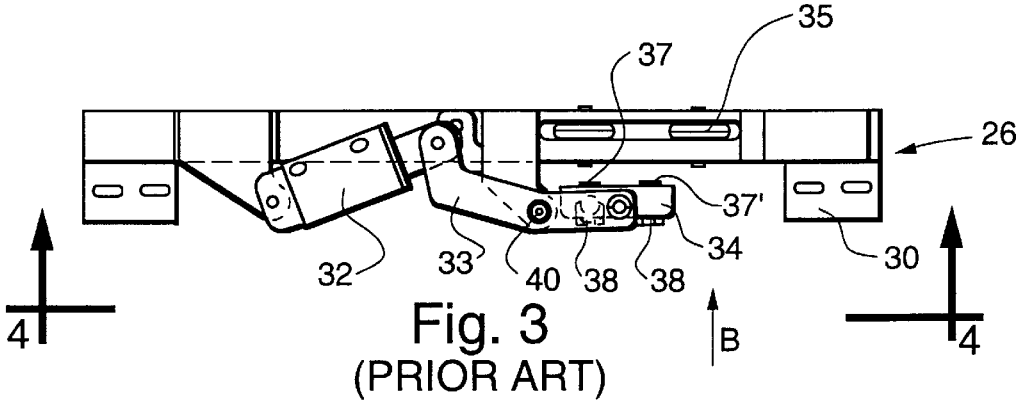
Fig. 3 (PRIOR ART)
FIG. 3 is a detailed top view illustrating the electrical contact mechanism of the prior art.
Figure 4:
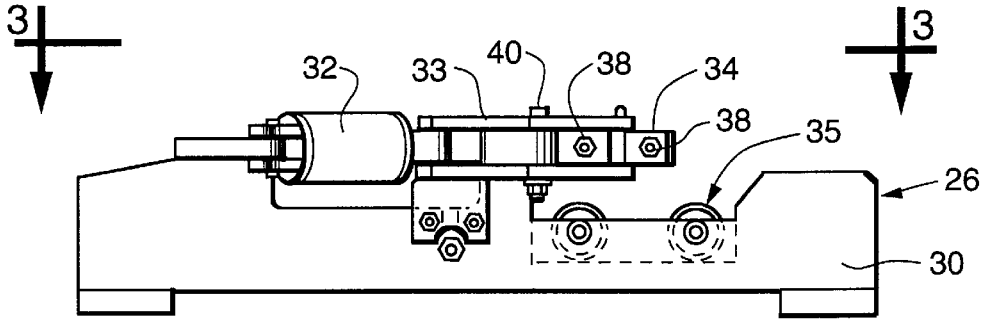
Fig. 4 (PRIOR ART)
FIG. 4 is a detailed side view illustrating the electrical contact mechanism of FIG. 3.

Referring now to the drawing, wherein like reference numerals refer to like elements throughout, FIGS. 5 through 11 show electroplating apparatus 100' having an electrical contact mechanism 26' in accordance with the present invention.

Figure 5:
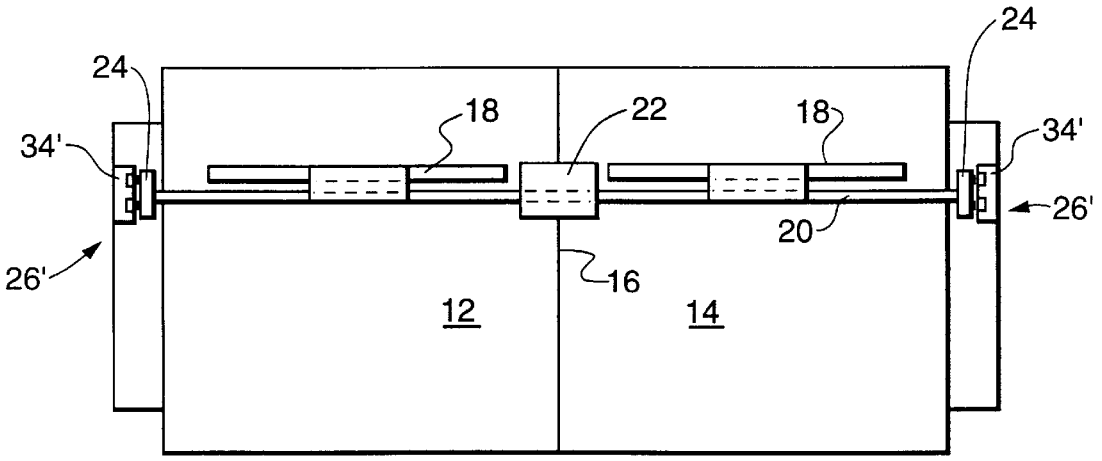
FIG. 5 is a top view illustrating electroplating apparatus having an exemplary electrical contact mechanism according to the present invention.

FIG. 5 shows a top view illustrating plating tank 101 having a contact mechanism 26' comprising contact block 34'. As shown in more detail in FIGS. 6 through 10, contact block 34' has one or more notches 50 in it. A conductive, inverted-L-shaped, pivotable contact 52 is mounted in each notch 50. Although exemplary contact block 34' is illustrated with two pivotable contacts 52 and two notches 50 in FIGS. 5 through 8, other embodiments in accordance with the present invention may have one pivotable contact 52 or more than two pivotable contacts 52. Each pivotable contact 52 is pivotably mounted within notch 50 on a pin 54. Each pin 54 rests, on one end, in a through-hole 56 in an outer wall 58 of contact block 34'; the other end of pin 54 rests in a hole 56' in a divider 60 between notches 50.

Each pivotable contact 52 has a wiping component 62 having an interior side 61 and an exterior side 63. Pivotable contact 52 also has a hole 64 through which pin 54 is inserted to pivotably attach contact 52 to contact block 34'. Each contact 52 has an associated spring 66 that inserts into recess 65 within notch 50 in contact block 34' . Spring 66 rests against interior side 61 of wiping component 62 of pivotable contact 52 and biases the contact to pivot away from the contact block 34'.

Figure 11:
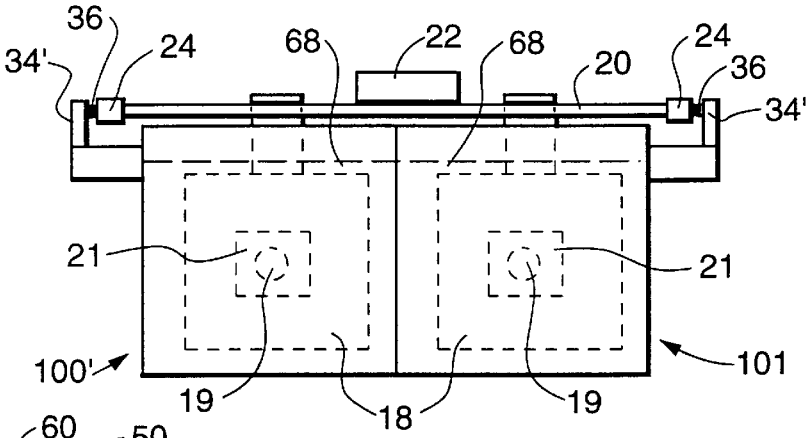
FIG. 11 is a side view illustrating the electroplating apparatus of FIG. 5 in a plating position.
Figure 7:
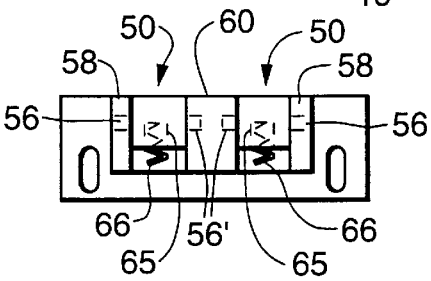
FIG. 7 is a top view illustrating the contact block of FIG. 6, with the pivotable contacts removed.
Figure 8:
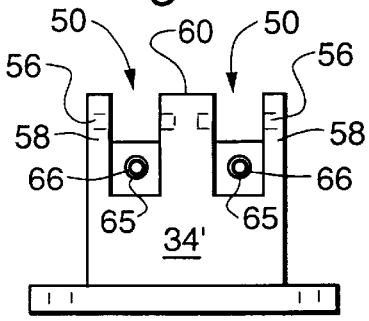
FIG. 8 is a side view illustrating the contact block of FIG. 7.
Figure 9:
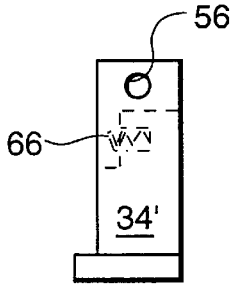
FIG. 9 is an end view illustrating the contact block of FIG. 7.

As shown in FIGS. 5 and 11, plating tank 101 has two contact mechanisms 26' mounted exterior to the plating tank, each mechanism having a contact block 34'. Thus, in use, flybar 20, having a fixed contact block 24 on each opposite end, is lowered into a plating position, as is shown in FIG. 11, so that plating fixtures 18 are submerged in the electroplating solution 68. As flybar 20 is lowered into plating position 68, each contact mechanism 26' on fixed contact block 24 wipes against one of pivotable contacts 52, pressing against exterior side 63 of wiping component 62, thus compressing spring 66. Contacts 36 on fixed contact block 24 thus remain touching against pivotable contacts 52 for as long as flybar 20 remains in the plating position.

The wiping motion created each time flybar 20 is raised and lowered tends to scrape away any corrosion byproducts that might otherwise build-up on contacts 36, 36' and 52 as a result of the corrosive conditions in the area around plating tank 101. The spring-loaded bias of pivotable contacts 52 assures that there is always a minimum at frictional force present during the wiping action. This constant, self-cleaning, wiping action keeps fixed contacts 36 and pivotable contacts 52 clean, thus assuring reliable electrical connections during electroplating and consequently more reliable product quality. Such an automatic cleaning operation is especially useful in electroplating operations where flybar 20 is raised and lowered automatically, such as by a robotic handling device (not shown) that may manipulate flybar 20 at robotic interface 22. Because of the infrequent human intervention in such automatic processes, self-cleaning contacts eliminate the need for frequent contact inspection.

Figure 6:
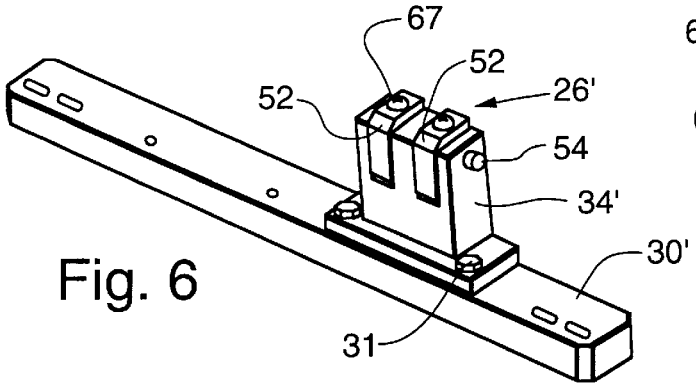
FIG. 6 is an isometric illustration of an exemplary contact block of the present invention.
Figure 10:
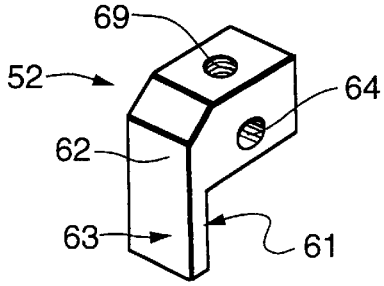
FIG. 10 is an isometric illustration of an exemplary pivotable contact of the present invention.

Contacts 52 may be connected to their respective electrical power supplies by a wire (not shown) that attaches to a screw 67 threaded into a hole 69. The screw 67, as well as contact 52 itself, pin 54, and spring 66 may be made of stainless steel. Contact block 34' may be made of a non-conductive plastic, such as PVDF. Such materials offer resistance to the corrosive environment near the electroplating solution 68. Contact block 34' may be mounted to base 30' with screws 31, as shown in FIG. 6, and may be mounted such that base 30' and its attachments may be substituted for frame 30 and its attachments as a simple retrofit to convert electroplating apparatus 100 to electroplating apparatus 100'.

Consistent with the electroplating operations known in the art and as described previously, electroplating apparatus 100' may further comprise one or more plating fixtures 18 attached to flybar 20, as shown in FIGS. 5 and 11. Each plating fixture 18 may have one or more substrates 19 attached to fixture 18, each substrate 19 adapted to be electroplated when flybar 20 is in the plating position. Such electroplating apparatus 100' may be especially useful for thin film electroplating of substrates 19.

Although the present invention has been described with reference to electroplating apparatus 100' having a flybar 20 with fixed contacts 36 and inverted-L-shaped, pivotable contacts 52 in contact block 34', other substrate carriers and configurations of spring-biased contacts could be used consistent with the present invention. The spring-biased contacts 52 could be mounted to the flybar 20 and the fixed contacts 36 mounted to the plating tank 101, or both sets of contacts may be spring-biased. It is essential only that there be a wiping motion between the contact(s) on the substrate carrier and the contact(s) attached to the power supply, and that the contact(s) in at least one location are spring-biased with sufficient frictional force to keep the contacts clean enough to provide a reliable electrical connection. This wiping motion could be achieved using spring-biased contacts conforming to any number of geometries and having any number of placements within contact block 34'. Similarly, contact blocks 24 and 34' may be of any geometry having any number of contacts, as long as the mating contacts align to provide a current path from the power supply to the substrates 19 to be electroplated.

Although illustrated and described with reference to certain specific embodiments, the present invention is nevertheless not intended to be limited to the details shown. Rather, various modifications may be made in the details within the scope and range of equivalents of the claims and without departing from the spirit of the invention.

What is claimed:

1. An electroplating apparatus adapted to electroplate at least one substrate, the apparatus comprising:

a plating tank adapted to contain electroplating solution;

a flybar adapted to maneuver the substrate into and out of a plating position; and an electrical contact mechanism having at least one second conductive contact not mounted to the flybar, and at least one first conductive contact mounted to the flybar and positioned (a) to touch said at least one second conductive contact with said flybar in the plating position and (b) to wipe against said at least one second conductive contact as said flybar is maneuvered into and out of said plating position, wherein at least one of said at least one first and second conductive contacts is connected to a power supply and at least one of said at least one first and second conductive contacts is spring-biased.

2. The electroplating apparatus according to claim 1, wherein said apparatus is adapted to electroplate the substrate with a thin film.

3. The electroplating apparatus according to claim 1, further comprising an acidic electroplating solution in said plating tank.

4. An electroplating apparatus adapted to electroplate at least one substrate, the apparatus comprising:

a plating tank adapted to contain electroplating solution;

a contact block having at least one notch therein;

at least one pivotable contact, each pivotable contact pivotably mounted within a notch in said contact block and having a wiping component with an interior side and an exterior side;

at least one spring, each spring mounted within a notch in said contact block between said contact block and the interior side of the wiping component of said pivotable contact, said spring positioned to bias said wiping component away from said contact block; and an electrical contact mechanism having (a) at least one second conductive contact, and (b) at least one first conductive contact mounted to a substrate carrier, said substrate carrier adapted to maneuver said substrate into and out of a plating position, said at least one first conductive contact positioned to touch said at least one second conductive contact with said substrate carrier in the plating position and to wipe against said at least one second conductive contact as said substrate carrier is maneuvered into and out of said plating position;

wherein at least one of said at least one first and second conductive contacts is connected to a power supply and at least one of said at least one first and second conductive contacts is spring-biased.

5. The electroplating apparatus according to claim 4, wherein said plating tank has opposite sides, each side having one of said contact blocks mounted thereon, and said substrate carrier further comprises a flybar having opposite ends and two of said first conductive contacts, one of said first conductive contacts mounted on each of said opposite ends of said flybar and positioned to wipe against the exterior side of the wiping component of one of said pivotable contacts and to compress said spring as said flybar is lowered into said plating position.

6. The electroplating apparatus according to claim 5, wherein said flybar is adapted to be raised and lowered automatically.

7. The electroplating apparatus according to claim 6, wherein said flybar is adapted to be maneuvered by a robotic handling device.

8. The electroplating apparatus according to claim 4, further comprising a pin attached to said contact block upon which said at least one pivotable contact is adapted to pivot.

9. The electroplating apparatus according to claim 8, further comprising a screw attached to said at least one pivotable contact, said screw adapted to be wired to a power supply, wherein said pivotable contact, said pin, said spring, and said screw are stainless steel.

10. The electroplating apparatus according to claim 9, wherein said at least one contact block is plastic.

11. An electroplating apparatus adapted to electroplate at least one substrate, the apparatus comprising:

a plating tank adapted to contain electroplating solution; and an electrical contact mechanism, said mechanism having:

(a) a substrate carrier adapted to maneuver said substrate into and out of a plating position, (b) at least one first conductive contact mounted to said substrate carrier and adapted to be electrically connected to a power supply and to carry current to said substrate, (c) a contact block mounted to said plating tank and having at least one notch therein, (d) at least one pivotable contact mounted within said at least one notch in said contact block and having a wiping component with an interior side and an exterior side, and (e) at least one spring, each spring mounted within said at least one notch in said contact block between said contact block and the interior side of the wiping component of said at least one pivotable contact, said spring positioned to bias said wiping component away from said contact block;

wherein said at least one first conductive contact is adapted (i) to engage said exterior side of said wiping component of said at least one pivotable contact when said substrate carrier is in the plating position and (ii) to wipe against said at least one pivotable contact as said substrate carrier is maneuvered into and out of said plating position.

12. The electroplating apparatus according to claim 11, further comprising a pin attached to said contact block in which said at least one pivotable contact is adapted to pivot.

13. The electroplating apparatus according to claim 12, further comprising a screw attached to said at least one pivotable contact, said screw adapted to be wired to a power supply, wherein said at least one pivotable contact, said pin, said at least one spring, and said screw are stainless steel.

14. The electroplating apparatus according to claim 13, wherein said contact block is plastic.

15. The electroplating apparatus according to claim 11, wherein said apparatus is adapted to electroplate the substrate with a thin film.

16. The electroplating apparatus according to claim 11, further comprising an acidic electroplating solution in said plating tank.

17. An electroplating apparatus having a plating tank with opposite sides containing electroplating solution, at least one substrate to be electroplated, and an electrical contact mechanism, said mechanism comprising:

a substrate carrier having a flybar with opposite ends, said flybar adapted to be raised and lowered automatically to maneuver said substrate into and out of a plating position;

a first conductive contact mounted to each of said opposite ends of said flybar of said substrate carrier and adapted to be electrically connected to a power supply and to carry current to said substrate;

a contact block mounted to each opposite side of said plating tank and having a pin and a notch therein;

at least one pivotable contact pivotably mounted on said pin and within said notch in each of said contact blocks and having a wiping component with an interior side and an exterior side;

at least one spring mounted within said notch in each of said contact blocks between said contact block and the interior side of the wiping component of said pivotable contact, said spring positioned to bias said wiping component away from said contact block;

wherein said first conductive contacts engage said exterior sides of said wiping components of said pivotable contacts when said substrate is in the plating position to wipe against said pivotable contacts as said substrate is maneuvered into and out of said plating position.

18. The electroplating apparatus according to claim 17, wherein said flybar is adapted to be maneuvered by a robotic handling device.

* * * * *